US010550726B2

(12) United States Patent
Moniz et al.

(10) Patent No.: US 10,550,726 B2
(45) Date of Patent: Feb. 4, 2020

(54) TURBINE SPIDER FRAME WITH ADDITIVE CORE

(71) Applicant: General Electric Company, Schenectady, NY (US)

(72) Inventors: Thomas Ory Moniz, Loveland, OH (US); Jordan Tesorero, Lynn, MA (US); Joshua Tyler Mook, Loveland, OH (US); Jeffrey Donald Clements, Mason, OH (US)

(73) Assignee: General Electric Company, Schenectady, NY (US)

( * ) Notice: Subject to any disclaimer, the term of this patent is extended or adjusted under 35 U.S.C. 154(b) by 264 days.

(21) Appl. No.: 15/419,080

(22) Filed: Jan. 30, 2017

(65) Prior Publication Data

US 2018/0216493 A1 Aug. 2, 2018

(51) Int. Cl.

| | |
|---|---|
| ***F01D 9/06*** | (2006.01) |
| ***F01D 25/26*** | (2006.01) |
| ***F01D 9/04*** | (2006.01) |
| ***F01D 25/16*** | (2006.01) |
| *F01D 25/24* | (2006.01) |
| *F01D 25/14* | (2006.01) |

(52) U.S. Cl.

CPC ..... *F01D 25/26* (2013.01); *F01D 9/041* (2013.01); *F01D 9/065* (2013.01); *F01D 25/16* (2013.01); *F01D 9/04* (2013.01); *F01D 25/14* (2013.01); *F01D 25/24* (2013.01); *F05D 2220/32* (2013.01); *F05D 2260/20* (2013.01)

(58) Field of Classification Search

CPC . F01D 25/24; F01D 9/04; F01D 9/065; F01D 25/14; F01D 25/16; F01D 25/26

See application file for complete search history.

(56) References Cited

U.S. PATENT DOCUMENTS

| | | | | |
|---|---|---|---|---|
| 4,920,742 | A * | 5/1990 | Nash | F01D 25/162 415/116 |
| 4,987,736 | A * | 1/1991 | Ciokajlo | F01D 9/065 415/138 |
| 8,061,969 | B2 | 11/2011 | Durocher et al. | |
| 8,371,812 | B2 | 2/2013 | Matiega et al. | |
| 9,140,137 | B2 | 9/2015 | Mayer et al. | |
| 9,222,413 | B2 | 12/2015 | Farah et al. | |

(Continued)

OTHER PUBLICATIONS

International Search Report and Written Opinion issued in connection with corresponding PCT Application No. PCT/US2017/065257 dated Mar. 27, 2018.

*Primary Examiner* — Nathaniel E Wiehe
*Assistant Examiner* — Andrew J Marien
(74) *Attorney, Agent, or Firm* — Dority & Manning, P.A.

(57) ABSTRACT

The present disclosure is directed to a gas turbine engine defining an axial centerline, a longitudinal direction, a radial direction, and a circumferential direction. The gas turbine engine includes one or more frames in which the frame defines an inner ring and an outer ring generally concentric to the inner ring about the axial centerline. The frame defines a plurality of struts extended outward along the radial direction from the inner ring to the outer ring. One or more struts define one or more service passages extended at least partially along the radial direction within the strut, and wherein the inner ring, the outer ring, and the struts together define an integral structure.

18 Claims, 7 Drawing Sheets

(56) References Cited

U.S. PATENT DOCUMENTS 9,284,887 B2 3/2016 McKenney et al.
9,447,694 B2 9/2016 Sanchez et al.
10,138,809 B2 * 11/2018 Schwarz et al. ..... F02C 3/107
2010/0132371 A1 6/2010 Durocher et al.
2011/0081237 A1 * 4/2011 Durocher ..... F01D 9/06 415/173.1
2015/0308343 A1 10/2015 Scott et al.
2015/0308344 A1 * 10/2015 Vo ..... F01D 9/065 415/213.1
2015/0322815 A1 * 11/2015 Scott ..... F01D 25/24 415/200
2015/0330249 A1 * 11/2015 Budnick ..... F01D 25/12 415/116
2015/0337682 A1 * 11/2015 Yeager ..... F01D 9/065 415/1
2015/0345330 A1 * 12/2015 Budnick ..... F01D 25/162 415/177
2015/0354382 A1 12/2015 Pakkala et al.
2015/0354410 A1 * 12/2015 Budnick ..... F01D 25/28 415/177
2016/0006226 A1 * 1/2016 Moisei ..... F01D 17/02 174/72 R
2016/0017754 A1 1/2016 Kumar
2016/0023275 A1 * 1/2016 Propheter-Hinckley ..... B22F 3/1055 416/96 A
2016/0032775 A1 * 2/2016 Wang ..... F01D 9/065 415/213.1
2016/0108757 A1 * 4/2016 Mickelsen ..... F01D 25/005 415/1
2016/0108814 A1 4/2016 Schmitz
2016/0130980 A1 5/2016 McKenney et al.
2016/0160800 A1 6/2016 Knowles et al.
2016/0201490 A1 * 7/2016 Scott ..... F01D 25/24 415/213.1
2016/0208699 A1 7/2016 Cherolis et al.
2016/0222807 A1 * 8/2016 Liebl ..... F01D 9/04
2016/0230604 A1 8/2016 Light et al.
2016/0290169 A1 10/2016 Karafillis et al.
2017/0130610 A1 * 5/2017 Nanda ..... F01D 5/145

* cited by examiner

TURBINE SPIDER FRAME WITH ADDITIVE CORE

FIELD

The present subject matter relates generally to gas turbine engine architecture. More particularly, the present subject matter relates to a turbine section for gas turbine engines.

BACKGROUND

Gas turbine engines generally include one or more structural frames within the engine, such as between compressors of a compressor section or turbines of a turbine section. The frames may provide support for bearing assemblies and may additionally provide areas to route pipes or manifolds from an outer diameter to an inner diameter, such as to provide air and oil to bearing assemblies.

However, known frames within gas turbine engines often include a plurality of separate components fastened or assembled together, such as rings, vanes, pipes, manifolds, or other structural members. As a result, frames generally include large part quantities, weights, thicknesses, and/or diameters for routing components within certain structures, such as pipes within vanes. Still further, known frames may reduce gas turbine engine efficiency and performance by increasing a blockage in the core flowpath due to large and/or numerous vanes or struts extending through the flowpath.

Therefore, there exists a need for a gas turbine engine frame that may provide structural support for bearing assemblies while improving gas turbine engine efficiency and performance by reducing weight, reducing part count, and/or reducing blockage of the core flowpath.

BRIEF DESCRIPTION

Aspects and advantages of the invention will be set forth in part in the following description, or may be obvious from the description, or may be learned through practice of the invention.

The present disclosure is directed to a gas turbine engine defining an axial centerline, a longitudinal direction, a radial direction, and a circumferential direction. The gas turbine engine includes one or more frames in which the frame defines an inner ring and an outer ring generally concentric to the inner ring about the axial centerline. The frame defines a plurality of struts extended outward along the radial direction from the inner ring to the outer ring. One or more struts define one or more service passages extended at least partially along the radial direction within the strut, and wherein the inner ring, the outer ring, and the struts together define an integral structure.

In various embodiments, at least one or more of the service passages defined within the strut at least partially defines an oblong cross section. In one embodiment, the oblong cross section is asymmetric.

In various embodiments, the frame further comprises a first middle ring and a second middle ring each extended along the longitudinal direction and the circumferential direction and disposed between the inner ring and the outer ring along the radial direction. In one embodiment, the frame further includes one or more airfoils surrounding each strut at least between the first middle ring and the second middle ring along the radial direction, and wherein each airfoil defines a pressure side and a suction side. In another embodiment, one or more of the struts defines a surface defining the airfoil. In still another embodiment, each airfoil defines walls generally surrounding each strut from the upstream end toward the downstream end. In still yet another embodiment, the first middle ring, the second middle ring, and the airfoil together define a fairing formed as segments disjointed along the circumferential direction. In still another embodiment, the struts encompass approximately 15% or less of a cross sectional area of the annular core flowpath.

In one embodiment, the plurality of struts each define an inner end and an outer end at each service passage, and wherein one or more struts further define a tube fitting at the inner end and the outer end of each service passage of the strut.

In another embodiment, one or more struts defines at least three service passages extended at least partially along the radial direction within the strut.

In yet another embodiment, wherein an additive manufacturing process defines the integral structure of the inner ring, the outer ring, and the struts.

In various embodiments, one or more struts defines a plurality of cooling passages extended at least partially along the radial direction. In one embodiment, the one or more struts further define one or more cooling channels extended at least partially in the longitudinal direction, the radial direction, and/or the circumferential direction, and wherein the plurality of cooling passages are connected among one another via one or more cooling channels.

In one embodiment, one or more struts defines a first cooling passage and a second cooling passage each extended at least partially around one or more service passages.

In various embodiments, the gas turbine engine further includes a shaft extended along the longitudinal direction and generally coaxial to the axial centerline, in which the shaft defines an upstream end and a downstream end; a compressor section comprising a plurality of seals and/or shrouds, the compressor section connected to and rotatable with the shaft, and wherein the compressor section is connected toward the upstream end of the shaft; and a turbine section including a plurality of seals and/or shrouds, the turbine section connected to and rotatable with the shaft, and wherein the turbine section is connected toward the downstream end of the shaft. In one embodiment, the gas turbine engine further includes a bearing assembly coupled to an inner diameter of the inner ring of the frame, in which the shaft is mechanically loaded onto the bearing assembly. In another embodiment, the turbine section defines a first turbine and a second turbine. The frame is disposed between the first turbine and the second turbine along the longitudinal direction. In one embodiment, the compressor section defines a first compressor and a second compressor, and wherein the frame is disposed between the first compressor and the second compressor along the longitudinal direction.

In another embodiment, the frame defines between approximately 3 and 8 struts, inclusively.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
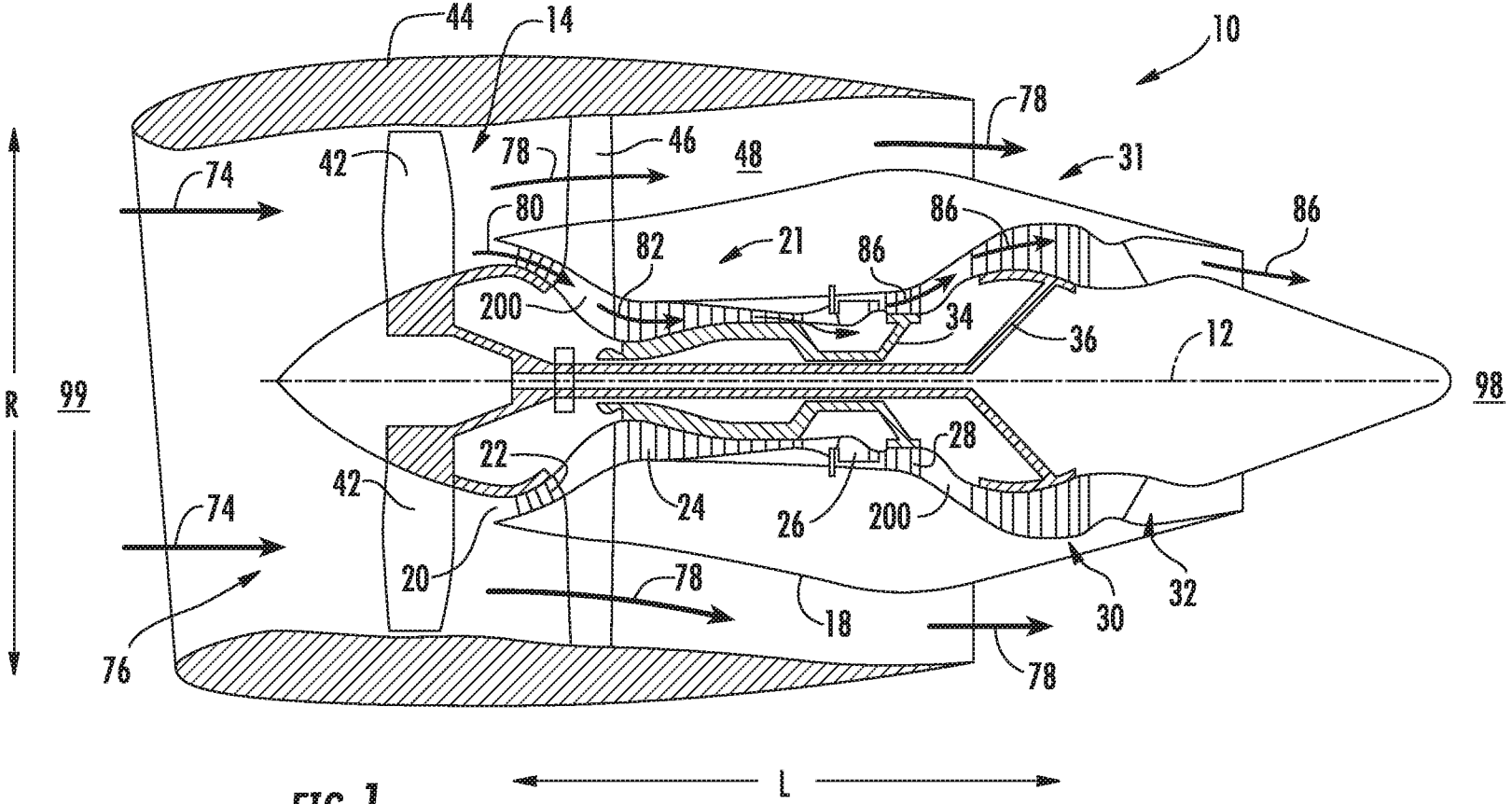
FIG. 1 is a schematic cross sectional view of an exemplary gas turbine engine incorporating an exemplary embodiment of a turbine section according to an aspect of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

A gas turbine engine including one or more spider frames with an additive core is generally provided that may provide structural support for bearing assemblies while improving gas turbine engine efficiency and performance by reducing weight, part count, and/or blockage of a core flowpath of the engine. The engine generally includes one or more spider frames, in which the frame defines an inner ring and an outer ring generally concentric to the inner ring about an axial centerline. The frame defines a plurality of struts extended outward along a radial direction from the inner ring to the outer ring. One or more struts define one or more service passages extended at least partially along the radial direction within the strut. The inner ring, the outer ring, and the struts together define an integral structure.

In various embodiments, the frame may further define a first middle ring and a second middle ring extended along a longitudinal direction and a circumferential direction and disposed between the inner ring and the outer ring. The first middle ring and the second middle ring may together define an annular core flowpath therebetween. The second middle ring and the outer ring may together define an annular secondary flowpath therebetween. One or more of the service passages may define an oblong cross section (e.g., elliptical, or ovular, or asymmetric, or generally non-circular).

The various embodiments of the engine and spider frame may reduce part quantity, radial dimensions, axial dimensions, and/or reduced strut quantity over known frames. Additionally, the frame may improve engine efficiency and performance by reducing strut thickness, thereby reducing a quantity or amount of a circumferential area of the core flowpath occupied or obstructed by the struts. Still further, oblong service passages through the struts may be defined specifically to optimize flow or pressure through the service passage relative to the thickness of the strut. For example, a non-circular service passage may reduce the strut thickness while providing adequate or improved flow and/or pressure for a hydraulic or pneumatic fluid through the struts.

Referring now to the drawings, FIG. 1 is a schematic cross sectional view of an exemplary gas turbine engine 10 (herein referred to as "engine 10"), shown as a high bypass turbofan engine, incorporating an exemplary embodiment of a turbine section 31 according to an aspect of the present disclosure. Although further described below with reference to a turbofan engine, the present disclosure is also applicable to turbomachinery in general, including propfan, turbojet, turboprop, and turboshaft gas turbine engines, including marine and industrial turbine engines and auxiliary power units. As shown in FIG. 1, the engine 10 has a longitudinal or axial centerline axis 12 that extends there through for reference purposes. The engine 10 defines a longitudinal direction L, a radial direction R, a circumferential direction C (shown in FIG. 2) and an upstream end 99 and a downstream end 98 along the longitudinal direction L.

In general, the engine 10 may include a substantially tubular outer casing 18 that defines an annular inlet 20. The outer casing 18 encases or at least partially flows, in serial flow arrangement, a compressor section 21, a combustion section 26, and a turbine section 31. In the embodiment shown in FIG. 1, the compressor section 21 defines a first compressor 22 and a second compressor 24 in serial arrangement. In various embodiments, the first compressor 22 defines a low or intermediate pressure compressor high pressure compressor. The second compressor 24 defines an intermediate or high pressure compressor. The turbine section 31 defines a second turbine 28 and a first turbine 30 in serial arrangement. In various embodiments, the second turbine 28 defines a high pressure turbine or intermediate pressure turbine. In still various embodiments, the first turbine 30 defines an intermediate pressure turbine or low pressure turbine. In yet other embodiments, the second turbine 28 or second turbine 30 may define portions of a low, intermediate, or high pressure turbine (e.g., two portions of a low pressure turbine). It should be appreciated that in various embodiments, the compressor section 21 and/or the turbine section 31 may define a third compressor and/or turbine rotatably coupled to one another.

The fan assembly 14 includes a fan rotor 15. The fan rotor 15 includes a plurality of fan blades 42 that are coupled to and extend outwardly along the radial direction R from the fan rotor 15 and/or a first shaft 36. In various embodiments, the fan assembly 14 may further define a plurality of stages of airfoils, such as defining a plurality of fan blades 42 and a low pressure compressor (LPC). The plurality of blades 42, the fan rotor 15, and the first shaft 36 are together rotatable about the axial centerline 12. An annular fan casing or nacelle 44 circumferentially surrounds at least a portion of the fan assembly 14 and/or at least a portion of the outer casing 18. In one embodiment, the nacelle 44 may be supported relative to the outer casing 18 by a plurality of circumferentially-spaced outlet guide vanes or struts 46. At least a portion of the nacelle 44 may extend over an outer portion (in radial direction R) of the outer casing 18 so as to define a bypass airflow passage 48 therebetween.

Figure 2:
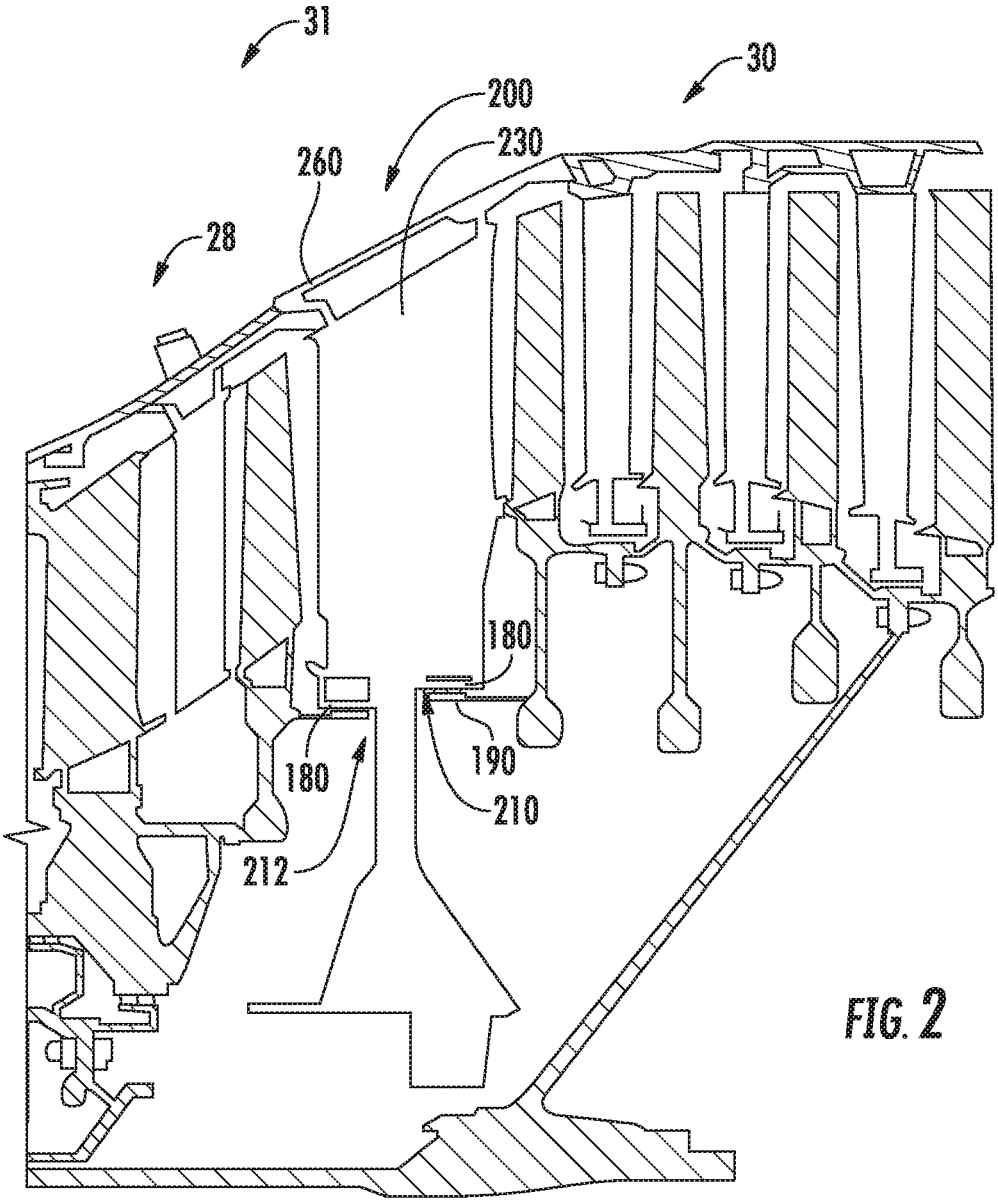
FIG. 2 is a cross sectional side view of an exemplary embodiment of the turbine section of engine shown in FIG. 1.

In FIG. 2, a schematic cross sectional side view of an exemplary embodiment of the turbine section 31 of the engine 10 is generally provided. Referring now to FIGS. 1 and 2, each turbine 28, 30 of the turbine section 31 is generally connected to a rotatable with each compressor 22, 24 of the compressor section 21 and/or the fan assembly 14. For example, in various embodiments, the second turbine 28 may be connected to and rotatable with the second compressor 24 and the first turbine 30 may be connected to and rotatable with the first compressor 22. In still various embodiments, the first turbine 30 may be connected to and rotatable with the fan assembly 14 in addition to, or separately, from the first compressor 22. In various embodiments, the first turbine 30 and first compressor 22 may define a low pressure or intermediate pressure spool connected by the first shaft 36. The second turbine 28 and the second compressor 24 may define a high pressure spool connected by a second shaft 34.

Referring still to FIGS. 1 and 2, the engine 10 further includes a plurality of bearing assemblies 300 coupled to a static structure, such as a spider frame 200 (hereinafter referred to as "frame 200"), and coupled or disposed between each shaft 34, 36. Each frame 200 may be disposed between the first compressor 22 and the second compressor 24 of the compressor section 21, or between the first turbine 28 and the second turbine 30 of the turbine section 31. It should be appreciated that the frame 200 may further be disposed between additional compressors of the compressor section 21 or turbines of the turbine section 31 (e.g., a third compressor or a third turbine).

The bearing assemblies 300 may generally define one or more of a ball or thrust bearing, a roller bearing, a tapered roller bearing, a journal bearing, or an air bearing. In various embodiments, the bearing assembly 300 is coupled to an inner diameter 212 of an inner ring 210 of the frame 200. The shaft 34, 36 is mechanically loaded onto the bearing assembly 300. The loading from the shaft 34, 35, 36 may further flow or route through the frame 200 from an integral structure including the inner ring 210, an outer ring 260, and a plurality of struts 230.

During operation of the engine 10, as shown in FIGS. 1-2 collectively, a volume of air as indicated schematically by arrows 74 enters the engine 10 through an associated inlet 76 of the nacelle and/or fan assembly 14. As the air 74 passes across the fan blades 42, a portion of the air as indicated schematically by arrows 78 is directed or routed into the bypass airflow passage 48 while another portion of the air as indicated schematically by arrows 80 is directed or through the fan assembly 14. Air 80 is progressively compressed as it flows through the compressor section 21 toward the combustion section 26.

The now compressed air, as indicated schematically by arrows 82, flows into the combustion section 26 where a fuel is introduced, mixed with at least a portion of the compressed air 82, and ignited to form combustion gases 86. The combustion gases 86 flow into the turbine section 31, causing rotary members of the turbine section 31 to rotate and support operation of respectively coupled rotary members in the compressor section 21 and/or fan assembly 14.

Figure 3:
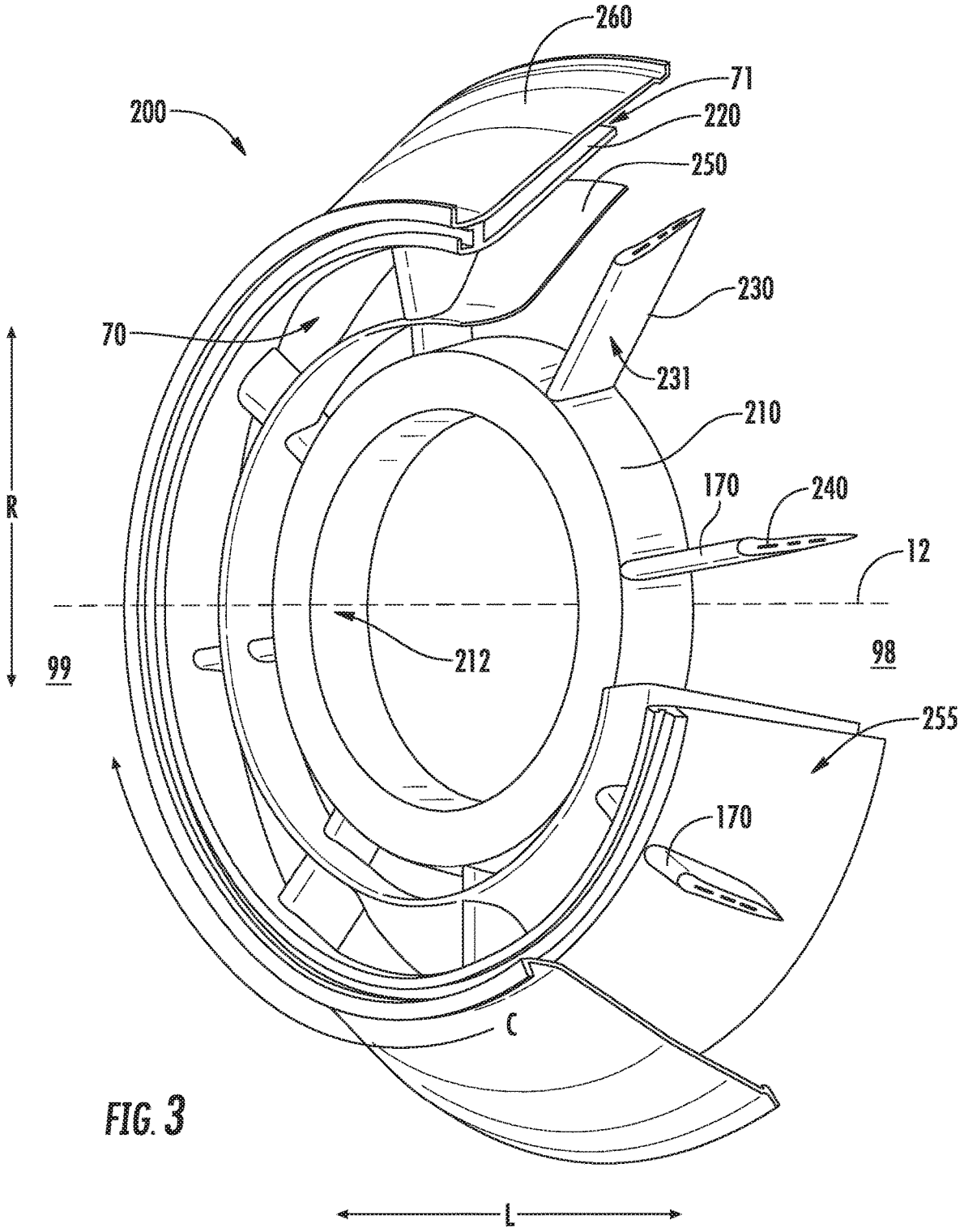
FIG. 3 is a partial cutaway perspective view of an exemplary embodiment of a frame of the gas turbine engine shown in FIG. 1.
Figure 4:
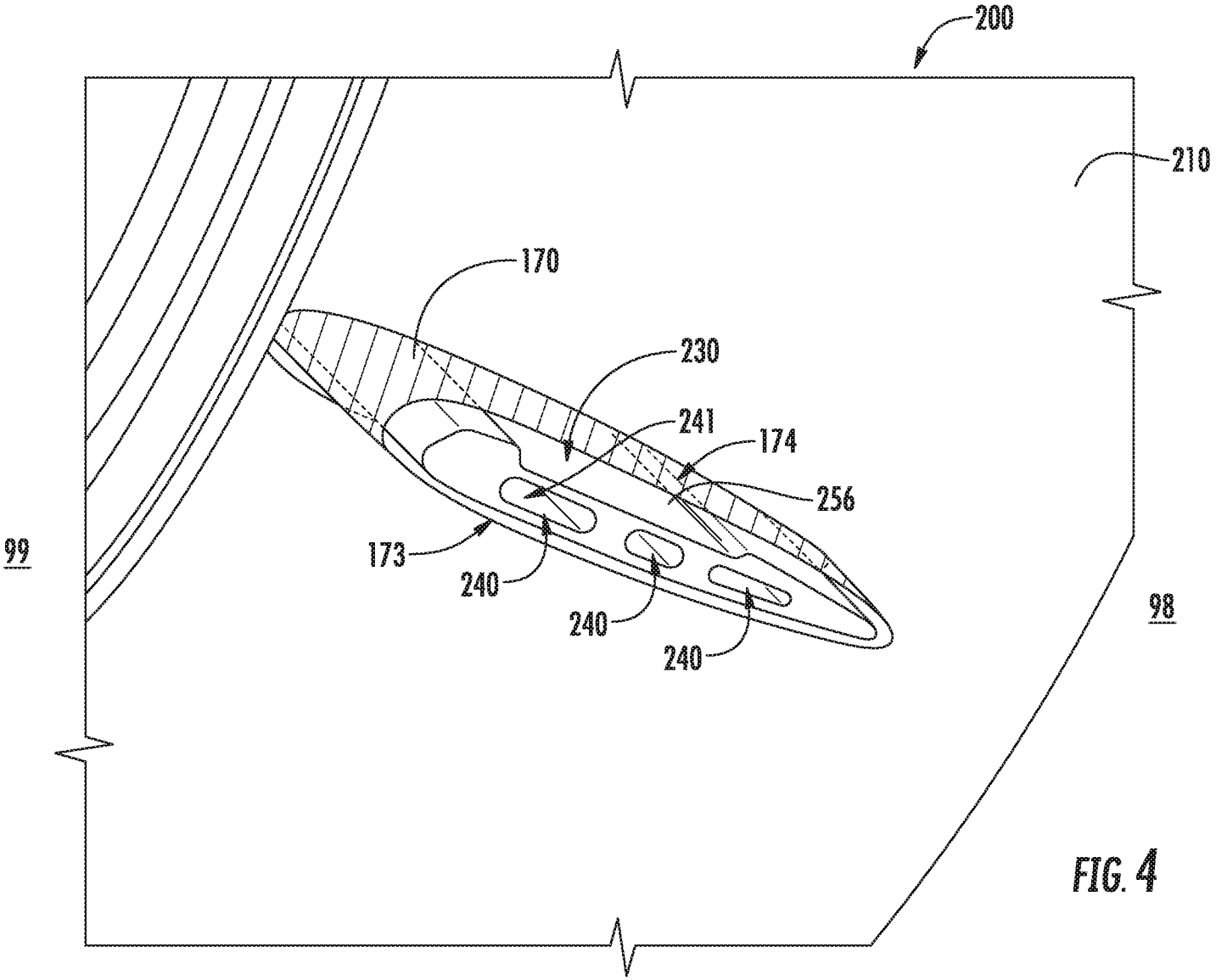
FIG. 4 is a partial cutaway perspective view of an exemplary embodiment of a strut of the frame shown in FIG. 2.

In FIG. 3, a partial cutaway perspective view of an exemplary embodiment of the spider frame 200 is generally provided. In FIG. 4, a close-up perspective view of another exemplary embodiment of the spider frame 200 is generally provided. Referring to FIGS. 1-4, the frame 200 is generally disposed within the turbine section 31, such as between a first turbine and a second turbine. For example, the first turbine 30 and the second turbine 28 may include any pair of turbines within the turbine section 31. In other embodiments, the frame 200 may be disposed within the compressor section 21, such as between the first compressor 22 and the second compressor 24.

Referring now to FIGS. 3 and 4, the frame 200 defines the inner ring 210 and the outer ring 260 generally concentric to the inner ring 210 about the axial centerline 12. The frame 200 defines the plurality of struts 230 extended outward along the radial direction R from the inner ring 210 to the outer ring 260. One or more of the struts 230 defines one or more service passages 240 extended at least partially along the radial direction R within the strut 230. In one embodiment, such as shown in FIG. 4, the one or more service passages 240 extended radially through the strut 230 may define a generally oblong cross section. For example, the generally oblong cross section may define an elliptical, ovular, asymmetric, or otherwise non-circular cross section. The inner ring 210, the outer ring 260, and the struts 230 together define an integral structure. For example, the inner ring 210, the outer ring 260, and the struts 230 may together be formed by one or more additive manufacturing or 3D printing methods.

In various embodiments, the frame 200 further defines a first middle ring 250 and a second middle ring 220 extended along the longitudinal direction L and the circumferential direction C. Each of the first and second middle rings 250, 220 are disposed between the inner ring 210 and the outer ring 260 along the radial direction R. The first middle ring 250 is disposed generally inward along the radial direction R of the second middle ring 220.

Figure 5:
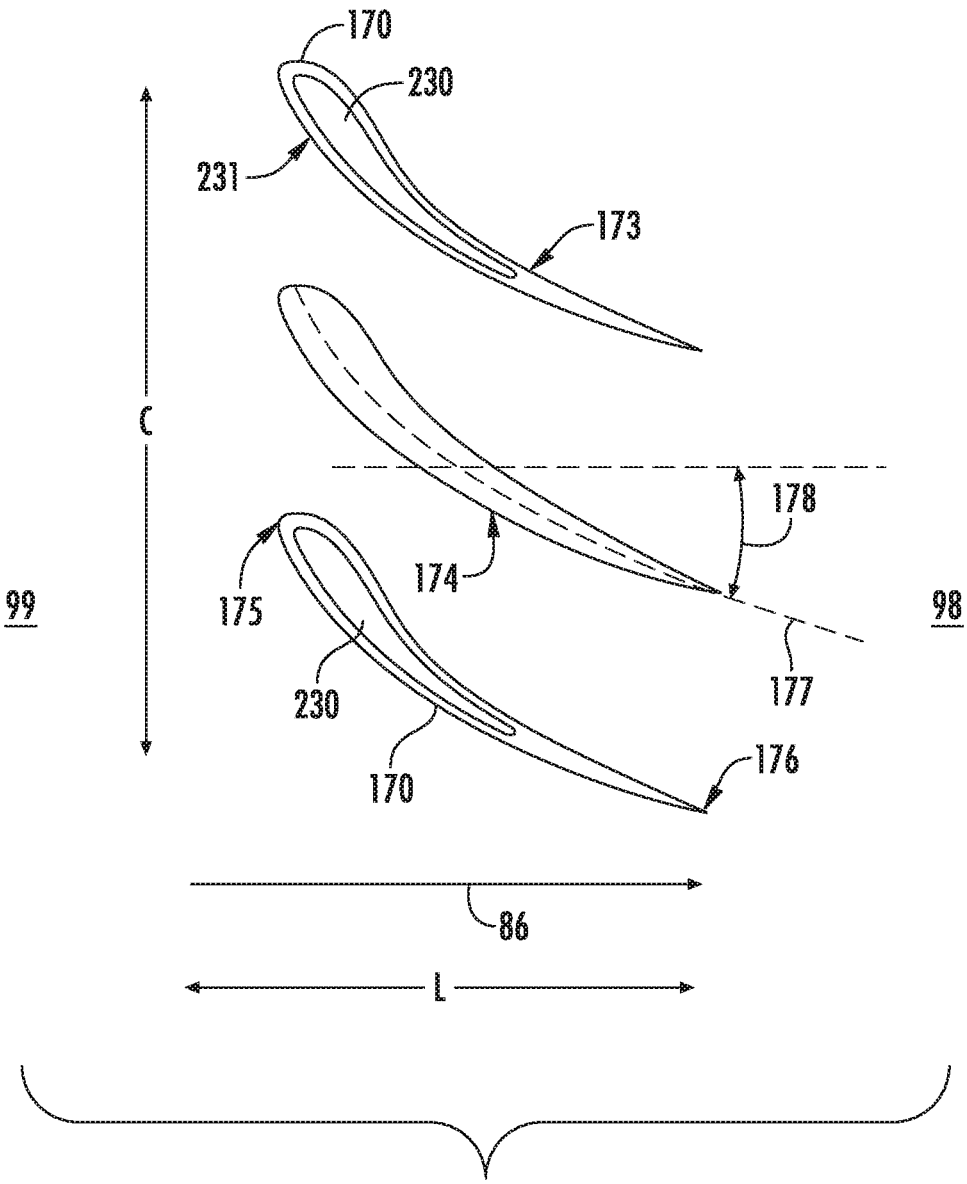
FIG. 5 depicts exemplary embodiments of orientations of airfoils of the frame and rotors depicted in FIGS. 1-4.

In FIG. 5, exemplary embodiments of a portion of the frame 200 are generally provided. Referring now to FIGS. 1-5, the frame 200 may further include one or more airfoils 170 surrounding each strut 230 at least between the first middle ring 250 and the second middle ring 220 along the radial direction R. In one embodiment, one or more of the struts 230 defines a surface 231 (shown in FIGS. 3 and 5) defining the airfoil 170. In another embodiment, each airfoil 170 defines walls generally surrounding each strut 230 from the upstream end 99 toward the downstream end 98. The airfoil 170 may define a suction side 173, a pressure side 174, a leading edge 175, and a trailing edge 176. In one embodiment, the suction side 173 is convex and the pressure side 174 is concave. In various embodiments, the airfoil 170 may define an exit angle 178 defined by an angular relationship of the axial centerline 12 to a camber line 177 extended through the airfoil 170. The resulting exit angle 178 may define the airfoil 170 such that the flow of combustion gases 86 across each airfoil 170 from the upstream end 99 toward the downstream end 98 exits at least partially in a first direction 161 in the circumferential direction C.

It should be appreciated that the exit angle 178 defines general angular relationships relative the axial centerline 12, such as a positive or negative acute angle. Therefore, each airfoil 170 defining the exit angle 178 may define a different magnitudes of angles in which each angle defines a generally positive or generally negative acute angle relative to the axial centerline 12.

In various embodiments, the first middle ring 250, the second middle ring 220, and the airfoils 170 surrounding the struts 230 together define an integral structure, such as formed by one or more additive manufacturing or 3D printing methods. In one embodiment, the first middle ring 250, the second middle ring 220, and the airfoil 170 are together segmented along the circumferential direction C. For example, the first middle ring 250, the second middle ring 220, and the airfoil 170 may together be segmented into two or more pieces that together define an annular structure disposed between the outer ring 260 and the inner ring 210.

Referring still to FIGS. 1-5, in one embodiment, the first middle ring 250, the second middle ring 220, and the airfoil 170 are formed as segments disjointed along the circumferential direction C, wherein each segment of the first middle ring 250, the second middle ring 220, and the airfoil 170 together define a fairing 255. In one embodiment, such as shown in FIG. 3, the frame 200 may include approximately four fairings 255 in adjacent arrangement along the circumferential direction C. In another embodiment, the frame 200 may include two or more fairings 255 of approximately equal segments along the circumferential direction C. In other embodiments, the frame 200 may include two or more fairings 255 of unequal segments along the circumferential direction C. In still another embodiment, the fairing 255 may define an integral structure formed by one or additive manufacturing processes. The fairings 255 may be disposed at least partially around a plurality of struts 230. The fairings 255 and the struts 230 may together define an annular core flowpath 70 as generally segregated from a secondary flowpath 71. The annular core flowpath 70 is at least partially defined between the first middle ring 250 and the second middle ring 220 along the radial direction R and extended at least partially along the longitudinal direction L. The secondary flowpath 71 is at least partially defined between the second middle ring 220 and the outer ring 260 along the radial direction R and extended at least partially along the longitudinal direction L.

Figure 6:
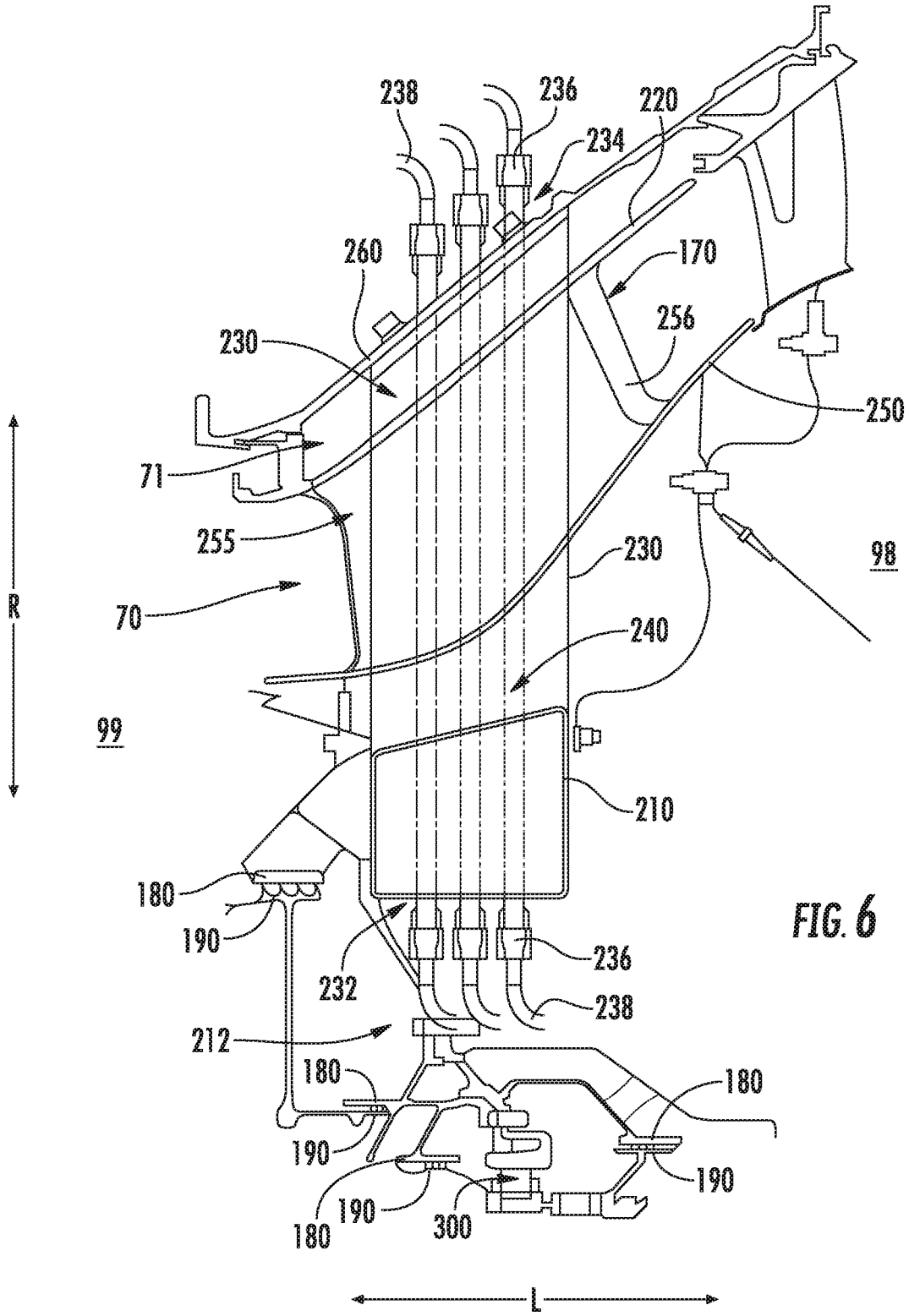
FIG. 6 is a cross sectional side view of an exemplary embodiment of a turbine section of an engine including one or more of the frames shown in FIG. 2.

Referring now to FIG. 6, a cross sectional side view of an exemplary embodiment of the frame 200 is generally provided. In the embodiments provided in FIGS. 4 and 6, the airfoil 170 of the fairing 255 surrounds the strut 230 at a portion of the strut 230 defined in the annular core flowpath 70. The airfoil 170 surrounding the fairing 255 may define a cavity 256 therebetween. In an embodiment in which the frame 200 is disposed in the turbine section 31, the fairing 255 protects the struts 230 from the combustion gases 86 (see FIG. 1) in the annular core flowpath 70 flowing from the upstream end 99 to the downstream end 98. In various embodiments, a cooling fluid, such as air, or compressed air 82 from the compressor section 21, may flow in the cavity 256 between the airfoil 170 and the strut 230.

In the embodiment provided in FIG. 6, the plurality of struts 230 may each define an inner end 232 and an outer end 234 at each service passage 240. One or more struts 230 may further define a tube fitting 236 at the inner end 232 and/or the outer end 234 of each service passage 240 of the strut 230. In one embodiment, each tube fitting 236 is coupled to a pipe or manifold 238 and to the bearing assembly 300. In various embodiments, the one or more service passages 240 within one or more struts 230 may define a supply, scavenge, drain, and/or vent for a hydraulic and/or pneumatic fluid. Each service passage 240 coupled to the pipe or manifold 238 may supply, or remove, a lube, hydraulic, or pneumatic fluid to/from the bearing assembly 300.

Referring to FIGS. 1-6, in various embodiments, the frame 200 defines between approximately three and eight struts 230, inclusively. For example, as shown in FIG. 3, the frame 200 may define eight struts 230. In other embodiments, the frame 200 may define at least three struts 230 that may substantially fix the inner ring 210, the outer ring 260, the middle rings 220, 250 in generally concentric and/or coaxial alignment about the axial centerline 12. In still various embodiments, each strut 230 defines a structural member supporting at least a portion of a load generated by the shaft 34, 36, the compressor section 21, the turbine section 31, the inner ring 210, the outer ring 260, and/or the middle rings 220, 250.

In various embodiments, the struts 230 may collectively encompass approximately 15% or less of a cross sectional area (along the circumferential direction C) of the annular core flowpath 70. In one embodiment, the struts 230 may collectively encompass approximately 10% or less of the cross sectional area of the annular core flowpath 70 at the frame 200. In another embodiment, the struts 230 may collectively encompass approximately 5% or less of the cross sectional area of the annular core flowpath 70 at the frame 200.

Figure 7:
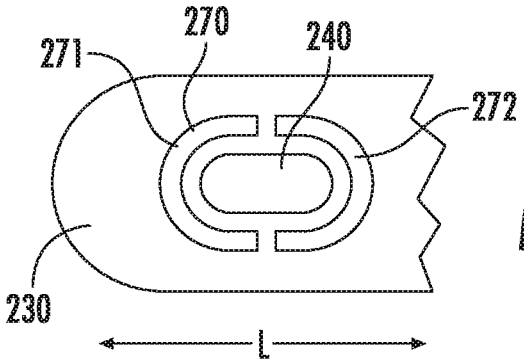
FIG. 7 is an exemplary embodiment of cooling passages within the frame.
Figure 8:
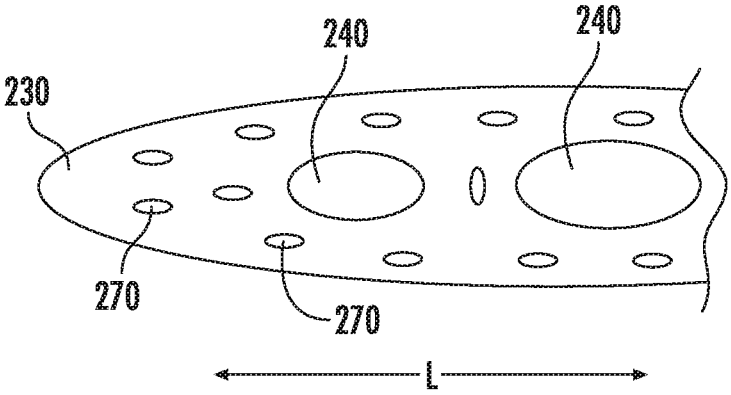
FIG. 8 is another exemplary embodiment of cooling passages within the frame.
Figure 9:
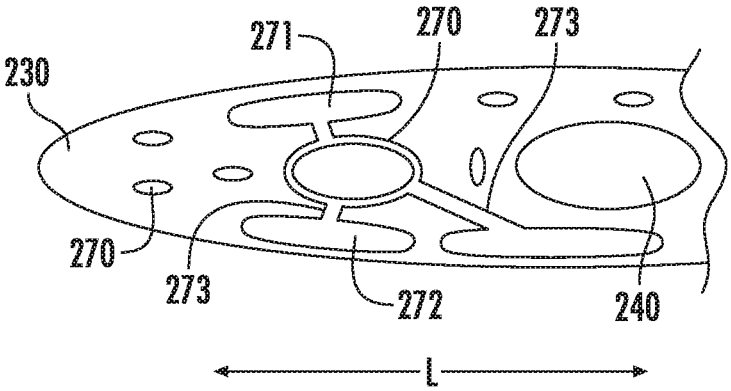
FIG. 9 is yet another exemplary embodiment of cooling passages within the frame.

Referring now to FIGS. 7-9, exemplary embodiments of the frame 200 are generally provided in which one or more struts 230 defines one or more cooling passages 270. The one or more cooling passages 270 extend at least partially along the radial direction R (shown in FIGS. 3 and 6) within one or more of the struts 230. In one embodiment, one or more struts 230, the outer ring 260, and the inner ring 210 together define an integral structure defining the cooling passages 270.

In various embodiments, the cooling passages 270 include a first cooling passage 271 and the second cooling passage 272. Referring to FIG. 7, the first cooling passage 271 and the second cooling passage 272 each extend at least partially around one or more service passages 240. In one embodiment, one or more struts 230 define a wall 241 that defines each service passage 240. In the embodiment shown in FIG. 7, the first cooling passage 271 and/or the second cooling passage 272 around each service passage 240 and approximately equidistant from the wall 241 of each service passage 240. Although FIG. 7 depicts a first cooling passage 271 and a second cooling passage 272 extended at least partially around the service passage 240, it should be understood that a further quantity of cooling passages 270 may extend around the service passage 240 (e.g. a third, or fourth, or fifth, etc. cooling passage).

Referring now to FIG. 8, the strut 230 may define a plurality of cooling passages 270 extended at least partially along the radial direction R within the strut 230. In one embodiment, the cooling passages 270 may define an oblong cross section (e.g., elliptical, or ovular, or asymmetric, or generally non-circular).

Referring now to FIG. 9, the strut 230 may define the plurality of cooling passages 270 further connected among one another via one or more cooling channels 273. Each cooling channel 273 may extend at least partially in the longitudinal direction L, the circumferential direction C, and/or the radial direction R. In one embodiment, one or more of the cooling channels 273 may define a serpentine structure. For example, the cooling channel 273 may at least partially define a sinusoidal or curving passage from the first cooling passage 271 to the second cooling passage 272. In another embodiment, the cooling channel 273 extends from the first cooling passage 271 to the second cooling passage 272 to enable fluid communication between each passage 271, 272. In various embodiments, each cooling channel 273 may further extend to additional cooling passages 270 to enable fluid communication.

The various embodiments of the struts 230 shown and described in regard to FIGS. 7-9 may flow a fluid (e.g., air) that may provide heat transfer from the service passages 240. In one embodiment, the cooling passages 270 and/or cooling channels 273 may further define different geometries, areas, or volumes from one another. Each cooling passage 270 and/or cooling channel 273 may define different geometries that provide different flow rates, pressure changes, or generally different heat transfer effects. Still further, in another embodiment, each cooling channel 273 may define a volume at which a pressure and/or flow of fluid from one or more cooling passages 270 is normalized among other cooling passages 270 (e.g., differences in pressure, flow, or temperature are reduced between the first cooling passage 271 and the second cooling passage 272).

Referring back to FIGS. 1 and 2, the turbine section 31 may further define one or more shrouds 180 and seals 190 between each compressor 22, 24, or between each turbine 28, 30, or between either and frame 200. In various embodiments, the one or more shrouds 180 may define a wall or platform extended at least partially in the longitudinal direction L. In one embodiment, the shroud 180 is adjacent to the seals 190 in the radial direction R. The one or more seals 190 may define a knife fin or knife edge seal that extended generally toward the shroud 180 to define a generally pointed end that may contact the shroud 180. In various embodiments, one or more seals 190 may define a labyrinth seal adjacent to one or more compressors 22, 24 or turbines 28, 30 and one or more bearing assemblies 300.

The shrouds 180, seals 190, airfoils 170, or other portions of the turbine section 31 and/or compressor section 21 may further include coatings, such as, but not limited to, thermal coatings, including one or more layers of bond coats and thermal coats, or abrasives such as diamond or cubic boron nitride, aluminum polymer, aluminum boron nitride, aluminum bronze polymer, or nickel-chromium-based abradable coatings. Coatings may be applied by one or more methods, such as plasma spray, thermal spray, gas phase, or other methods.

Referring now to the embodiments shown and described in regard to FIGS. 1-9, each stage of the turbine section 31 may be constructed as individual blades installed into drums or hubs, or integrally bladed rotors (IBRs) or bladed disks, or combinations thereof. The blades, hubs, or bladed disks may be formed of ceramic matrix composite (CMC) materials and/or metals appropriate for gas turbine engine hot sections, such as, but not limited to, nickel-based alloys, cobalt-based alloys, iron-based alloys, or titanium-based alloys, each of which may include, but are not limited to, chromium, cobalt, tungsten, tantalum, molybdenum, and/or rhenium. For example, in one embodiment, at least a portion of the plurality of outer shroud airfoils 118 define a ceramic or CMC material.

The frame 200, or portions or combinations of portions thereof, such as the inner ring 210, the outer ring 260, and struts 230 may be formed together using additive manufacturing or 3D printing, or casting, forging, machining, or castings formed of 3D printed molds, or combinations thereof. Portions of the frame 200, such as shrouds 180, seals 190, or the fairings 255 may be joined to the inner ring 210, the outer ring 260, and/or struts 230 using mechanical fasteners, such as bolts, nuts, rivets, screws, etc., or using one or more joining methods, such as, but not limited to, welding, brazing, soldering, friction welding, diffusion bonding, etc.

The systems shown in FIGS. 1-9 and described herein may reduce part quantity, radial dimensions, axial dimensions, and/or reduced strut quantity over known frames. Additionally, the frame may improve engine efficiency and performance by reducing strut thickness, thereby reducing a quantity or amount of a circumferential area of the core flowpath occupied or obstructed by the struts. Still further, oblong service passages through the struts may be defined specifically to optimize flow or pressure through the service passage relative to the thickness of the strut. For example, a non-circular service passage may reduce the strut thickness while providing adequate or improved flow and/or pressure for a hydraulic or pneumatic fluid through the struts.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas turbine engine defining an axial centerline, a longitudinal direction, a radial direction, and a circumferential direction, the gas turbine engine comprising:

one or more frames defining an inner ring and an outer ring concentric to the inner ring about the axial centerline, wherein the one or more frames further define a plurality of struts extending outward along the radial direction from the inner ring to the outer ring, one or more of the plurality of struts defining a plurality of service passages extending at least partially along the radial direction within the strut, each of the plurality of service passages aligned along a longitudinal direction of the strut, the plurality of service passages each comprising an oblong cross section so as to optimize flow or pressure through the plurality of service passages relative to a thickness of the strut, wherein one or more of the plurality of struts defines a plurality of cooling passages extending at least partially along the radial direction and surrounding the plurality of service passages, and wherein the inner ring, the outer ring, and the plurality of struts together define an integral structure.

2. The gas turbine engine of claim 1, wherein the oblong cross section is asymmetric.

3. The gas turbine engine of claim 1, wherein the frame further comprises a first middle ring and a second middle ring each extended along the longitudinal direction of the gas turbine engine and the circumferential direction and disposed between the inner ring and the outer ring along the radial direction.

4. The gas turbine engine of claim 3, wherein the frame further includes one or more airfoils surrounding each strut at least between the first middle ring and the second middle ring along the radial direction, and wherein each airfoil defines a pressure side and a suction side.

5. The gas turbine engine of claim 4, wherein one or more of the struts defines a surface defining the airfoil.

6. The gas turbine engine of claim 5, wherein the plurality of struts encompass 15% or less of a cross sectional area of the annular core flowpath.

7. The gas turbine engine of claim 4, wherein each airfoil defines walls surrounding each strut from the upstream end toward the downstream end.

8. The gas turbine engine of claim 4, wherein the first middle ring, the second middle ring, and the airfoil together define a fairing formed as segments disjointed along the circumferential direction.

9. The gas turbine engine of claim 1, wherein the plurality of struts each define an inner end and an outer end at each of the plurality of service passages, and wherein one or more of the plurality of struts further define a tube fitting at the inner end and the outer end of each of the plurality of service passages of the strut.

10. The gas turbine engine of claim 1, wherein an additive manufacturing process defines the integral structure of the inner ring, the outer ring, and the plurality of struts.

11. The gas turbine engine of claim 1, wherein the one or more of the plurality of struts further define one or more cooling channels extending at least partially in the longitudinal direction, the radial direction, and/or the circumferential direction of the gas turbine engine, and wherein the plurality of cooling passages are connected among one another via one or more cooling channels.

12. The gas turbine engine of claim 11, wherein one or more of the plurality of struts defines a first cooling passage and a second cooling passage, the first cooling passage completely surrounding a first service passage of the plurality of service passages, wherein one of the one or more cooling channels connects the first cooling passage with a second cooling passage that is separate and spaced apart from the first service passage.

13. The gas turbine engine of claim 1, further comprising:

a shaft extended along the longitudinal direction of the gas turbine engine and coaxial to the axial centerline, wherein the shaft defines an upstream end and a downstream end;

a compressor section comprising a plurality of seals and/or shrouds, the compressor section connected to and rotatable with the shaft, and wherein the compressor section is connected toward the upstream end of the shaft; and a turbine section comprising a plurality of seals and/or shrouds, the turbine section connected to and rotatable with the shaft, and wherein the turbine section is connected toward the downstream end of the shaft.

14. The gas turbine engine of claim 13, further comprising:

a bearing assembly coupled to an inner diameter of the inner ring of the frame, wherein the shaft is mechanically loaded onto the bearing assembly.

15. The gas turbine engine of claim 13, wherein the turbine section defines a first turbine and a second turbine, and wherein the frame is disposed between the first turbine and the second turbine along the longitudinal direction.

16. The gas turbine engine of claim 13, wherein the compressor section defines a first compressor and a second compressor, and wherein the frame is disposed between the first compressor and the second compressor along the longitudinal direction.

17. The gas turbine engine of claim 1, wherein the frame defines between 3 and 8 struts, inclusively.

18. A gas turbine engine defining an axial centerline, a longitudinal direction, a radial direction, and a circumferential direction, the gas turbine engine comprising:

at least one frame defining an inner ring and an outer ring concentric to the inner ring about the axial centerline, the frame defining one or more struts extending outward along the radial direction from the inner ring to the outer ring, the one or more struts defining one or more service passages extending at least partially along the radial direction within the strut, the one or more service passages comprising an oblong cross section so as to optimize flow or pressure through the one or more service passages relative to a thickness of the one or more struts, the one or more struts defining a plurality of cooling passages extending at least partially along the radial direction and surrounding the one or more service passages, and wherein the inner ring, the outer ring, and the struts together define an integral structure.

* * * * *